US009752795B2

(12) United States Patent
Park et al.

(10) Patent No.: US 9,752,795 B2
(45) Date of Patent: Sep. 5, 2017

(54) INDOOR UNIT OF AIR CONDITIONER

(71) Applicant: SAMSUNG ELECTRONICS CO., LTD., Suwon-si, Gyeonggi-do (KR)

(72) Inventors: Kwang Deuk Park, Suwon-si (KR); Kyeong Ae Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 366 days.

(21) Appl. No.: 14/454,267

(22) Filed: Aug. 7, 2014

(65) Prior Publication Data

US 2015/0040602 A1 Feb. 12, 2015

(30) Foreign Application Priority Data

Aug. 9, 2013 (KR) ..... 10-2013-0094829

(51) Int. Cl.
*F24F 13/22* (2006.01)
*F24F 1/00* (2011.01)

(52) U.S. Cl.
CPC ..... *F24F 13/222* (2013.01); *F24F 1/0007* (2013.01); *F24F 2001/0048* (2013.01)

(58) Field of Classification Search
CPC ..... F24F 2013/221; F24F 1/0025; F24F 2001/0048; F24F 13/14; F24F 13/1406; F24F 13/222; F24F 1/0007; F24F 13/22; F24F 13/10; F24F 13/08; F24F 13/20; F24F 13/24
USPC ..... 222/22; 454/277, 347, 358; 62/428; 165/231
See application file for complete search history.

(56) References Cited

U.S. PATENT DOCUMENTS

2005/0223732 A1* 10/2005 Kim ..... F24F 1/0011 62/298
2012/0134794 A1* 5/2012 Matsumoto ..... F24F 1/0025 415/203

FOREIGN PATENT DOCUMENTS

| | | | |
|---|---|---|---|
| EP | 2 009 364 | 12/2008 | |
| EP | 2096370 A1 * | 9/2009 | ..... F24F 1/0011 |
| EP | 2 469 194 | 6/2012 | |
| EP | 2 778 550 | 9/2014 | |
| EP | 2 799 790 | 11/2014 | |

(Continued)

OTHER PUBLICATIONS

PCT International Search Report mailed Nov. 17, 2014 in corresponding PCT Application No. PCT/KR2014/007391.

(Continued)

*Primary Examiner* — Frantz Jules
*Assistant Examiner* — Schyler S Sanks
(74) *Attorney, Agent, or Firm* — Staas & Halsey LLP

(57) ABSTRACT

An indoor unit including a heat exchanger that cools indoor air sucked through a suction port, a cross flow fan that enables the indoor air to be sucked through the suction port, and enables cold air cooled by the heat exchanger to be discharged into a room through a discharging port, a drainage tray unit that is disposed below the heat exchanger to collect condensate water generated in the heat exchanger, and a blade that is rotatably coupled to the drainage tray unit to open the discharging port, and whose rotary shaft is formed in an upper portion of the discharging port. The drainage tray unit includes a guide unit that prevents the cold air from being discharged to an upper side of the blade so that the cold air is discharged to a lower side of the blade when the blade is opened.

8 Claims, 7 Drawing Sheets

(56) References Cited

FOREIGN PATENT DOCUMENTS

| | | | | |
|---|---|---|---|---|
| EP | 2 986 919 | | 2/2016 | |
| JP | 61-138946 | | 8/1986 | |
| JP | 11-148675 | | 6/1999 | |
| JP | 11-173643 | | 7/1999 | |
| JP | 2006-138629 | | 6/2006 | |
| JP | 4700127 | B2 * | 6/2011 | ..... F24F 1/0007 |
| KR | 10-2006-0008087 | | 1/2006 | |
| KR | 10-2007-009866 | | 1/2007 | |
| KR | 10-2007-0078843 | | 8/2007 | |
| KR | 10-2004-0106056 | | 12/2007 | |
| WO | WO 2013/065395 | | 5/2013 | |
| WO | WO 2013/099914 | | 7/2013 | |

OTHER PUBLICATIONS

Australian Office Action issued on Jul. 22, 2016 in corresponding Australian Patent Application No. 2014305257.

Extended European Search Report issued on Jan. 26, 2017 in corresponding European Patent Application No. 14 83 5269.

Australian Office Action issued on Jan. 9, 2017 in corresponding Australian Patent Application No. 2014305257.

Russian Office Action dated Apr. 24, 2017 in corresponding Russian Patent Application No. 2016107885/12(012473).

Russian Search Report dated Apr. 24, 2017 in corresponding Russian Patent Application No. 2016107885/12(012473).

Australian Notice of Acceptance for Patent Application dated Mar. 29, 2017 in corresponding Australian Patent Application No. 2014305257.

* cited by examiner

INDOOR UNIT OF AIR CONDITIONER

CROSS-REFERENCE TO RELATED APPLICATIONS

This application claims the benefit of Korean Patent Application No. 10-2013-0094829, filed on Aug. 9, 2013 in the Korean Intellectual Property Office, the disclosure of which is incorporated herein by reference.

BACKGROUND

1. Field

Embodiments of the present disclosure relate to an indoor unit of an air conditioner and, more particularly, to an indoor unit of an air conditioner that may prevent occurrence of dew formation due to cold air at a discharging port of the air conditioner.

2. Description of the Related Art

In general, an air conditioner is a home electric appliance that sucks indoor warm air, cools the sucked air using a low-temperature refrigerant, and then discharges the cooled air into a room to cool the inside of the room.

The air conditioner is constituted of an outdoor unit disposed outdoors and an indoor unit disposed indoors. Here, the indoor unit includes an air blowing fan that sucks indoor air and discharges heat-exchanged air, a heat exchanger that perform heat-exchange on the sucked indoor air and a cold refrigerant, a drainage tray unit that collects and drains condensate water generated in the heat exchanger, a blade that opens and closes the discharging port, and a left/right wind direction adjustment unit that adjusts left and right discharging directions of discharged air.

Meanwhile, the blade is rotatably provided in the discharging port, and particularly, when a rotary shaft of the blade is provided in the vicinity of a center portion of the discharging port, dry and cold air is discharged through upper and lower sides of the blade in a case of opening the blade.

In this manner, when the dry and cold air is discharged through upper and lower sides of the blade, a dew point is not generated in the discharging port, and therefore dew formation hardly occurs. However, when the rotary shaft of the blade is provided in an upper portion of the discharging port, most of the dry and cold air is discharged to the lower side of the blade, and only a part of the dry and cold air is discharged to the upper side of the blade. In this instance, a dew point is generated in the upper side of the blade, and therefore dew formation may occur.

SUMMARY

Therefore, it is an aspect of the present disclosure to provide an indoor unit of an air conditioner in which a rotary shaft of a blade for opening and closing a discharging port is provided in an upper portion of a discharging port, and therefore dew formation that occurs at an upper side of the blade may be prevented.

Additional aspects of the disclosure will be set forth in part in the description which follows and, in part, will be obvious from the description, or may be learned by practice of the disclosure.

In accordance with one aspect of the present disclosure, an indoor unit of an air conditioner includes: a main body that includes a suction port and a discharging port; a heat exchanger that cools indoor air sucked through the suction port; a cross flow fan that enables the indoor air to be sucked through the suction port, and enables cold air cooled by the heat exchanger to be discharged into a room through the discharging port; a drainage tray unit that is disposed below the heat exchanger to collect condensate water generated in the heat exchanger; and a blade that is rotatably coupled to the drainage tray unit to open the discharging port, and whose rotary shaft is formed in an upper portion of the discharging port. Here, the drainage tray unit may include a stabilizer unit that guides the cold air heat-exchanged through the heat exchanger towards the discharging port without backflow, a guide unit that protrudes towards the blade from the stabilizer unit to prevent the cold air from being discharged through a gap between the blade and the stabilizer unit in a state in which the blade is opened, and a rounded portion that roundly extends from the stabilizer unit so that a receiving space for receiving a part of the blade is formed when the blade is opened.

Also, the drainage tray unit may be integrally formed.

Also, the stabilizer unit may include a first portion formed roundly to be spaced apart from the cross flow fan by a predetermined interval, a second portion formed roundly towards the discharging port from the first portion, and a third portion formed flat towards the discharging port from the second portion, and the guide unit may extend flat to have the same inclination as the third portion.

Also, the guide unit may restrict a rotation range of the blade by interfering with the blade when the blade is opened.

Also, the blade and the guide unit may be disposed in parallel with each other while the blade is completely opened.

Also, the blade may make a surface contact with the guide unit to prevent the cold air from leaking to a gap between the blade and the guide unit in a state in which the blade is completely opened.

Also, a support shaft coupling unit that rotatably supports the blade may be provided in the guide unit.

Also, the blade may include a support shaft that is rotatably supported by a shaft support portion.

The blade may include an insulating material that is provided between an inner surface of the blade and an outer surface thereof to prevent a transfer of heat between the inner surface and the outer surface.

In accordance with another aspect of the present disclosure, an indoor unit of an air conditioner includes: a main body that includes a suction port and a discharging port; a heat exchanger that cools indoor air sucked through the suction port; a cross flow fan that enables the indoor air to be sucked through the suction port, and enables cold air cooled by the heat exchanger to be discharged into a room through the discharging port; a drainage tray unit that is disposed below the heat exchanger to collect condensate water generated in the heat exchanger; and a blade that is rotatably coupled to the drainage tray unit to open the discharging port, and whose rotary shaft is formed in an upper portion of the discharging port. Here, the drainage tray unit includes a guide unit that controls a discharging direction of the cold air to prevent the cold air from being discharged to an upper side of the blade so that the cold air is discharged to a lower side of the blade in a state in which the blade is opened.

Also, the guide unit may protrude to the lower side of the blade to be parallel with the blade in a state in which the blade is completely opened.

Also, the guide unit may be provided integrally with the drainage tray unit

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
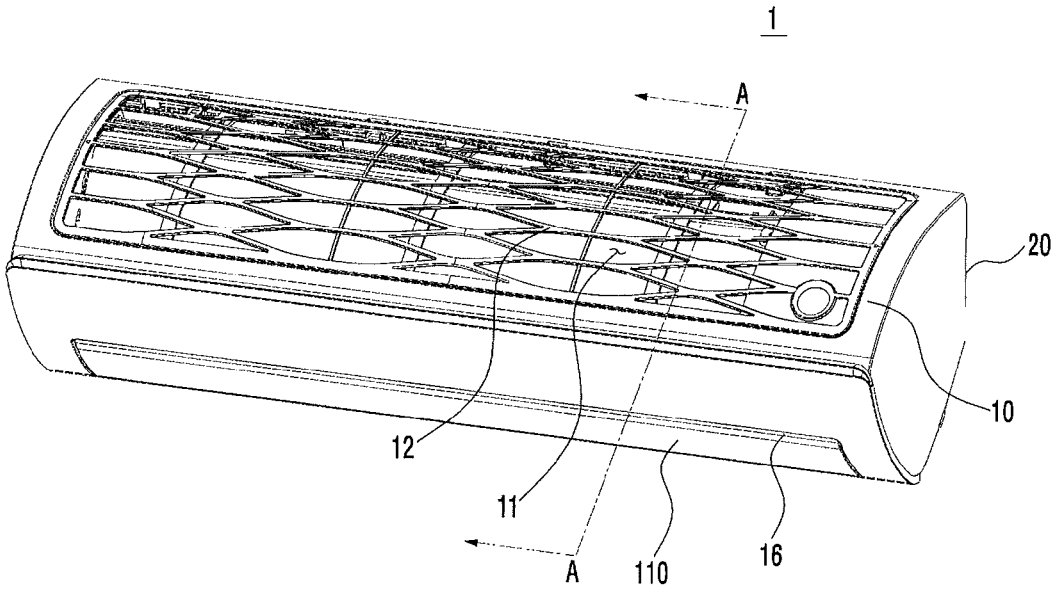
FIG. 1 illustrates an appearance of an indoor unit of an air conditioner in accordance with one embodiment of the present disclosure.

Reference will now be made in detail to the embodiments of the present disclosure, examples of which are illustrated in the accompanying drawings, wherein like reference numerals refer to like elements throughout.

Hereinafter, preferred embodiments of the present disclosure will be described in detail.

Figure 2:
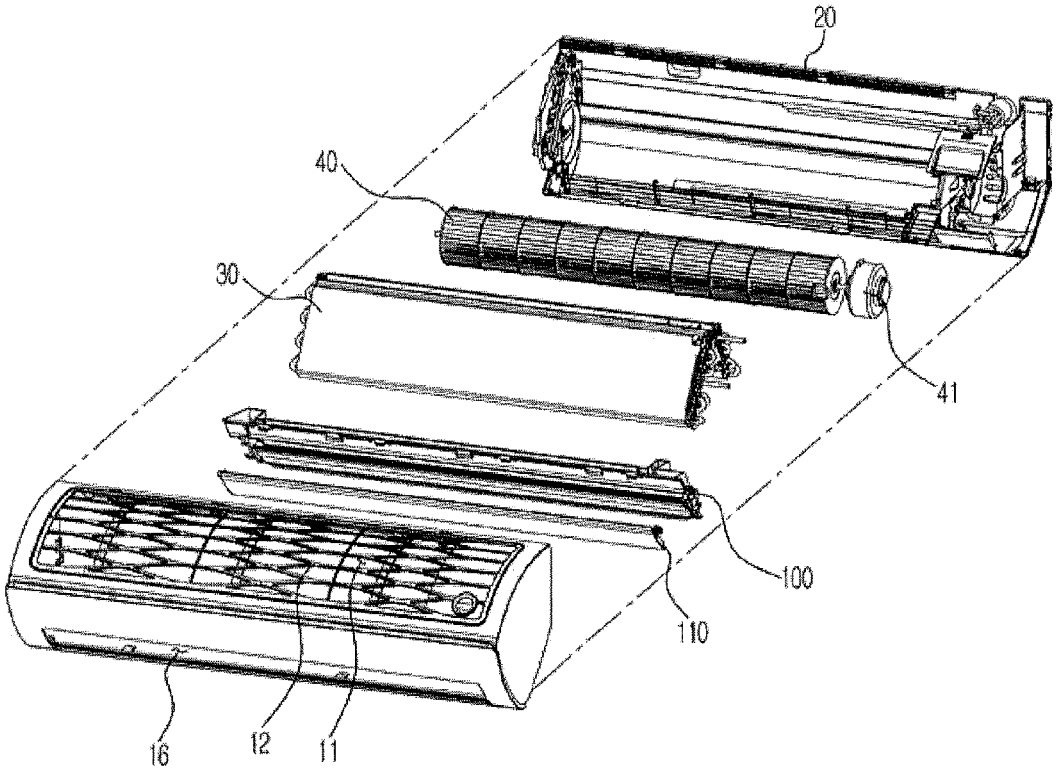
FIG. 2 is an exploded perspective view showing a configuration of the indoor unit of the air conditioner of FIG. 1.
Figure 3:
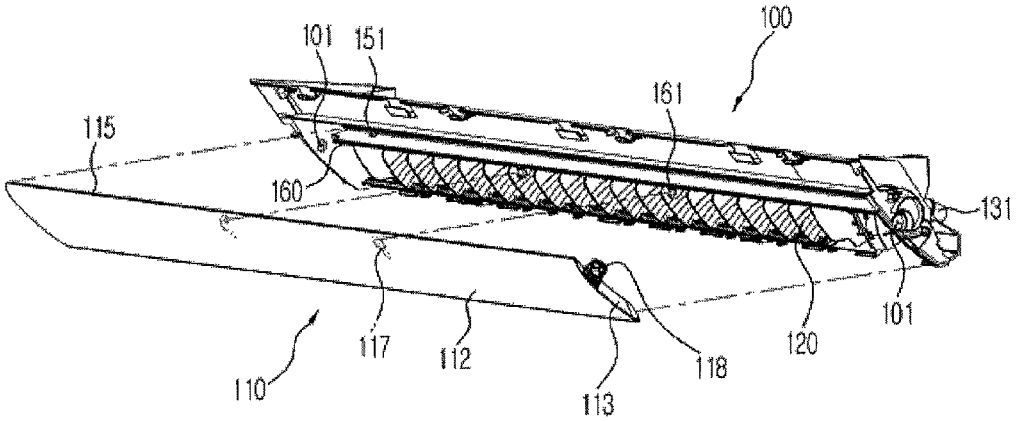
FIG. 3 is a perspective view showing a drainage tray unit of the indoor unit of the air conditioner of FIG. 1.
Figure 4:
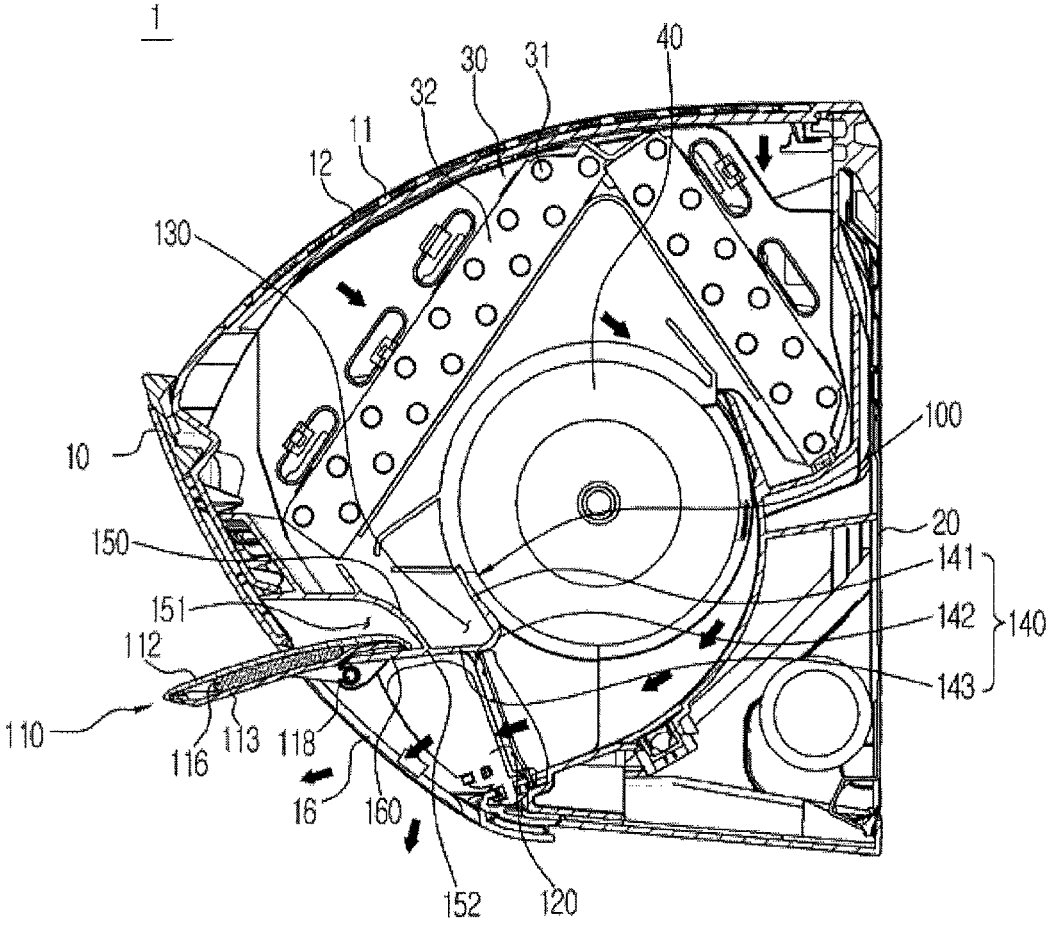
FIG. 4 is a cross-sectional view of A-A showing the indoor unit of the air conditioner of FIG. 1.
Figure 5:
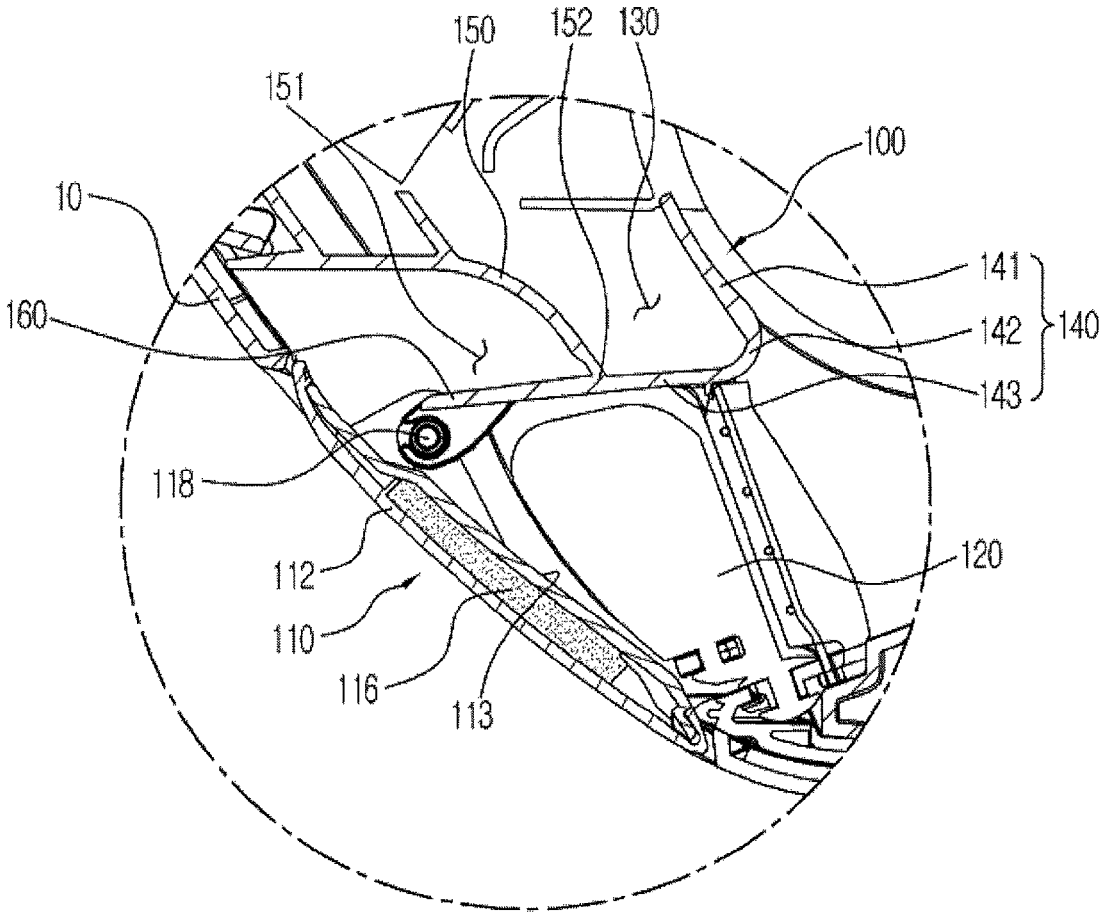
FIG. 5 is an enlarged cross-sectional view of A-A showing a state in which a blade of the indoor unit of the air conditioner of FIG. 1 is closed.
Figure 6:
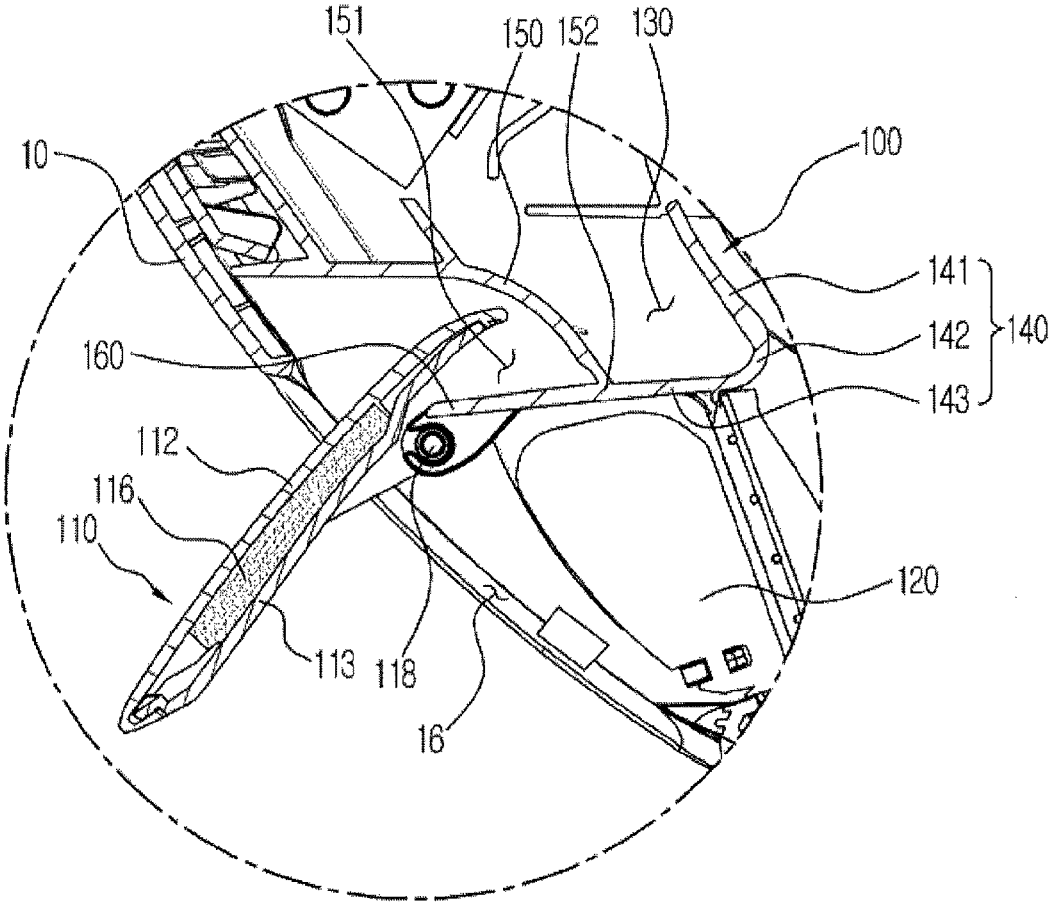
FIG. 6 is an enlarged cross-sectional view of A-A showing a state in which a blade of the indoor unit of the air conditioner of FIG. 1 is opened.
Figure 7:
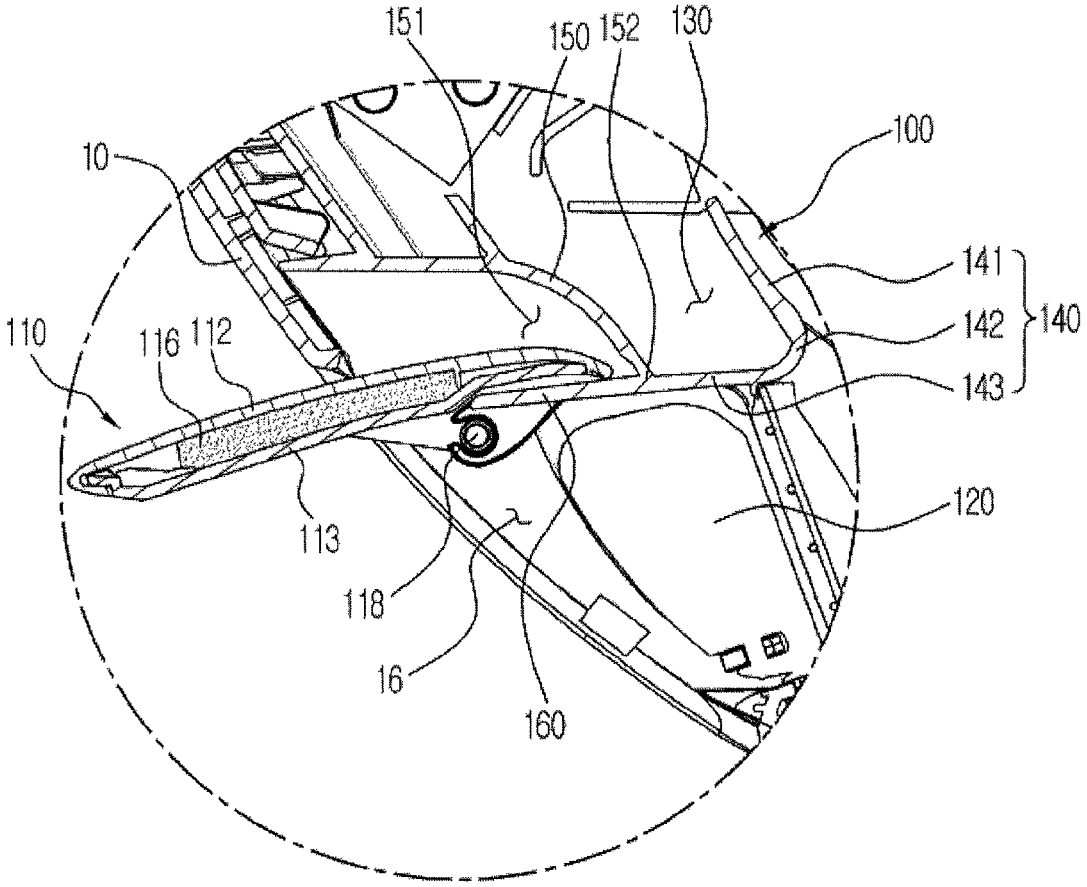
FIG. 7 is an enlarged cross-sectional view of A-A showing a state in which a blade of the indoor unit of the air conditioner of FIG. 1 is completely opened.

FIG. 1 illustrates an appearance of an indoor unit of an air conditioner in accordance with one embodiment of the present disclosure, FIG. 2 is an exploded perspective view showing a configuration of the indoor unit of the air conditioner of FIG. 1, FIG. 3 is a perspective view showing a drainage tray unit of the indoor unit of the air conditioner of FIG. 1, FIG. 4 is a cross-sectional view of A-A showing the indoor unit of the air conditioner of FIG. 1, FIG. 5 is an enlarged cross-sectional view of A-A showing a state in which a blade of the indoor unit of the air conditioner of FIG. 1 is closed, FIG. 6 is an enlarged cross-sectional view of A-A showing a state in which a blade of the indoor unit of the air conditioner of FIG. 1 is opened, and FIG. 7 is an enlarged cross-sectional view of A-A showing a state in which a blade of the indoor unit of the air conditioner of FIG. 1 is completely opened.

Referring to FIGS. 1 to 7, an indoor unit 1 of an air conditioner in accordance with one embodiment of the present disclosure is a wall-mounted indoor unit that can be mounted on a wall, and includes main bodies 10 and 20 which form an appearance of the indoor unit 1 and have a suction port 11 and a discharging port 16, a cross flow fan 40 that sucks indoor air to be heat-exchanged with a refrigerant and then discharges the heat-exchanged air, a heat exchanger 30 that heat-exchanges the sucked indoor air and the refrigerant, a blade 110 that opens and closes the discharging port 16, a left/right wind direction adjustment unit 120 that adjusts left and right wind directions of the discharged air, and a drainage tray unit 100 that collects and drains condensated water generated in the heat exchanger 30.

The main body may be formed in such a manner that a front housing 10 forms an appearance of the front surface of the indoor unit and a rear housing 20 forms the remaining appearance of the indoor unit. The suction port 11 for sucking indoor air is provided in an upper portion of the front housing 10, and the discharging port 16 for discharging the heat-exchanged air is provided in a lower portion of the front housing 10. A grill 12 for filtering foreign substances included in the sucked air may be provided in the suction port 11.

The heat exchanger 30 includes a tube 31 in which a refrigerant flows and a heat exchange pin 32 that is brought into contact with the tube 31 to enlarge a heat radiation area, and performs heat exchange in such a manner that warm air sucked from the inside of a room is brought into contact with the tube 31 and the heat exchange pin 32. The warm air sucked from the inside of the room is heat-exchanged with a refrigerant of the heat exchanger 30 to dry and cool the air.

The cross flow fan 40 sucks indoor air through the suction port 11 of the front housing 10, performs heat exchange on the sucked air through the heat exchanger 30, and discharges the heat-exchanged cold air to the discharging port 16 of the front housing 10.

A driving motor 41 for providing a rotational force to the cross flow fan 40 is connected to the cross flow fan 40.

The blade 110 is rotatably provided in the discharging port 16, and a rotary shaft 118 of the blade 110 is formed approximately in an upper portion of the discharging port 16. Thus, when the blade 110 is opened, the air cooled through the heat exchanger 30 is discharged through a lower side of the blade 110.

The rotary shaft 118 protrudes at both ends of the blade 110, and a rotary shaft coupling unit 101 to which the rotary shaft 118 of the blade 110 is rotatably coupled may be provided at both ends of the drainage tray unit 100.

In particular, the indoor unit of the air conditioner in accordance with one embodiment of the present disclosure includes a guide unit 160 that controls a discharging direction so that cold air is discharged to the lower side of the blade 110 when the blade 110 is opened, and therefore the cold air is fundamentally prevented from being discharged to an upper side of the blade 110.

In this manner, the cold air is prevented from being discharged to the upper side of the blade 110 because dew formation may occur in a front surface 112 of the blade 110 and the front housing 10 when the cold air is discharged to the upper side of the blade 110.

That is, due to a structure in which the rotary shaft 118 of the blade 110 is provided in an upper portion of the discharging port 16, a large amount of the cold air which has been dried through the heat exchanger 30 flows to the lower side of the blade 110, and therefore a dew point is not generated. However, a small amount of the cold air flows to the upper side of the blade 110, so that the dew point is generated to cause occurrence of dew formation.

An insulating material 116 may be provided between the front surface 112 and a rear surface 113 of the blade 110 so that a heat transfer between the rear surface 113 of the blade 110 and the front surface 112 the blade 110 is prevented.

The insulating material 116 is provided because dew formation may also occur in the front surface 112 of the blade 110 by conductive heat transfer between the cold air of the rear surface 113 of the blade 110 and the front surface 112 of the blade 110.

Thus, according to the indoor unit 1 of the air conditioner in accordance with one embodiment of the present disclosure, it is possible to prevent the cold air from flowing directly to the upper side of the blade 110 by the guide unit 160, that is, from flowing over the front surface 112 of the blade 110, and the insulating material 116 is provided between the front surface 112 and the rear surface 113 of the blade 110 to block heat transfer by conduction, thereby efficiently preventing occurrence of dew formation in the front surface 112 of the blade 110 or the front housing 10.

Meanwhile, such a guide unit 160 is not provided separately, and may be formed integrally in the drainage tray unit 100 to be described below. Thus, a separate component is not required, and an additional assembly process is not required. For example, the guide unit 160 may be integrally formed with the drainage tray unit 100 as a single piece, such as by injection molding. Hereinafter, a detailed configuration of each of the guide unit 160 and the drainage tray unit 100 will be described.

The drainage tray unit 100 is disposed below the heat exchanger 30 so as to collect and drain condensate water generated in the heat exchanger 30. The drainage tray unit 100 includes a collection portion 130 provided into a groove shape so as to collect condensated water, and a drain hose connection portion 131 to which a drain hose (not shown) for guiding the condensate water collected in the collection portion 130 to the outside of the main body is coupled.

Meanwhile, the drainage tray unit 100 further includes a stabilizer unit 140 that guides the cold air heat-exchanged through the heat exchanger 30 towards the discharging port 16 without backflow to the suction port 11, a rounded portion 150 that roundly extends from the stabilizer unit 140 so that a receiving space 151 for receiving a part of the blade 110 is formed when the blade 110 is opened, and the above-described guide unit 160.

The stabilizer unit 140 may be provided in the innermost side of the drainage tray unit 100, and include a first portion 141 formed roundly so as to be spaced from the cross flow fan 40 by a predetermined interval, a second portion 142 formed roundly towards the discharging port 16 from the first portion 141, and a third portion 143 formed approximately flat towards the discharging port 16 from the second portion 142.

The rounded portion 150 extends to be rounded towards a front upper side from the stabilizer unit 140 so as to be spaced apart from a radius of rotation of the blade 110 by a predetermined interval. The receiving space 151 for receiving the blade 110 when the blade 110 is opened is formed below the rounded portion 150. More specifically, the receiving space 151 is formed in a recessed groove shape between the rounded portion 150 and the guide unit 160.

The guide unit 160 prevents the cold air from being discharged through a gap between the blade 110 and the rounded portion 150 in a state in which the blade 110 is completely opened, thereby consequently preventing the cold air from being discharged to the upper side of the blade 110.

The guide unit 160 protrudes to the lower side of the blade 110 which is completely opened at a portion 152 where the stabilizer unit 140 and the rounded portion 150 meet together. The guide unit 160 protrudes in parallel with the blade 110 which may be completely opened or almost completely opened.

As described above, such a guide unit 160 prevents cold air from being discharged to the upper side of the blade 110 in a state in which the blade 110 is completely opened, and controls a discharging direction of the cold air so that the cold air is discharged to the lower side of the blade 110.

The guide unit 160 may be provided so as to make a surface contact with the blade 110 so that sealability between the blade 110 and the guide unit 160 is improved in a state in which the blade 110 is completely opened.

In addition, as another example, the guide unit 160 may act to restrict a rotation range of the blade 110 by interfering with the blade 110 when the blade 110 is opened.

A support shaft coupling unit 161 of FIG. 3 that supports rotation of the blade 110 may be provided in the guide unit 160, and a support shaft 117 that is rotatably supported by the support shaft coupling unit 161 of the guide unit 160 may be provided in the rear surface 113 of the blade 110. The support shaft 117 may be located by an edge 115 of the blade 110.

In this manner, the rotary shaft 118 formed at both ends of the blade 110 is rotatably coupled to the rotary shaft coupling unit 101 formed at both ends of the drainage tray unit 100, and the support shaft 117 formed in the rear surface 113 of the blade 110 is rotatably coupled to the support shaft coupling unit 161 of the guide unit 160, and therefore the blade 110 may be further rigidly coupled to the drainage tray unit 100 and rotation of the blade 110 may be smoothly realized.

With reference to FIGS. 5 to 7, operations of the blade 110 of the indoor unit of the air conditioner in accordance with one embodiment of the present disclosure will be described.

As shown in FIG. 5, when the blade 110 is closed, the blade 110 closes the discharging port 16. The front surface 112 (outer surface) of the blade 110 forms an appearance of the indoor unit, and the rear surface 113 (inner surface) of the blade 110 is hidden in the inside of the indoor unit.

As shown in FIGS. 6 and 7, when the indoor unit is operated, the blade 110 is rotated upward with respect to the rotary shaft 118. When the indoor unit is operated, the cross flow fan 40 sucks warm and humid air of the room into the indoor unit, the sucked air is cooled to cold and dry air while passing through the heat exchanger 30, and then the cooled air is discharged to the discharging port 16.

The rotary shaft 118 of the blade 110 is provided in approximately an upper portion of the discharging port 16, and therefore, when the blade 110 is completely opened, the blade 110 is rotated so that the front surface 112 of the blade 110 is positioned at an upper side in an upper portion of the discharging port 16 and the rear surface 113 of the blade 110 is positioned at a lower side.

In this instance, the guide unit 160 integrally formed in the drainage tray unit 100 is provided so as to protrude to the lower side of the blade 110, so that dry and cold air discharged through the discharging port 16 is induced or guided to be discharged to the lower side of the blade 110 while the dry and cold air is prevented from being discharged to the upper side of the blade 110.

When a small amount of the cold air is discharged to the upper side of the blade 110, a dew point may be generated in the upper side of the blade 110 to cause occurrence of dew formation, but the cold air is prevented from being discharged to the upper side of the blade 110 by the guide unit 160 extending to the lower side of the blade 110 in the drainage tray unit 100, thereby preventing occurrence of dew formation.

As is apparent from the above description, in accordance with the embodiments of the present disclosure, in the indoor unit of the air conditioner in which the rotary shaft of the blade for opening and closing the discharging port is provided in the upper portion of the discharging port, the guide unit for guiding the direction of the discharged air to the lower side of the blade is provided so as to prevent air from being discharged to the upper side of the blade, thereby preventing occurrence of the dew formation at the upper side of the blade.

In addition, guide unit 160 may be integrally formed in the drainage tray unit 100 as a single piece, such as by injection molding, and therefore a separate component is not required.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An indoor unit of an air conditioner comprising: a main body that includes a suction port and a discharging port; a heat exchanger that cools indoor air sucked through the suction port; a cross flow fan that enables the indoor air to be sucked through the suction port, and enables cold air cooled by the heat exchanger to be discharged into a room through the discharging port; a wind direction adjustment unit that adjusts wind directions of the air to be discharged through the discharging port; a drainage tray unit including a collection portion that is disposed below the heat exchanger to collect condensate water generated by the heat exchanger; and a blade that is rotatably coupled to the drainage tray unit to open the discharging port, the blade including a rotary shaft formed in an upper portion of the discharging port, wherein the drainage tray unit further includes: a stabilizer unit that guides the cold air heat-exchanged by the heat exchanger towards the discharging port without backflow having a portion with a surface facing the collection portion and an opposing surface facing the wind direction adjustment unit, a guide unit that protrudes towards the blade from the stabilizer unit to prevent the cold air from being discharged through a gap between the blade and the stabilizer unit in a state in which the blade is at least partially opened, a receiving space that receives a part of the blade when the blade is at least partially opened by a rotation of the rotary shaft, and a wall to separate the receiving space of the drainage tray unit from the collection portion of the drainage tray unit, wherein the stabilizer unit includes: a first portion formed roundly to be spaced apart from the cross flow fan by a predetermined interval; a second portion formed roundly towards the discharging port from the first portion; and a third portion formed flat towards the discharging port from the second portion and including the portion with the surface facing the collection portion and the opposing surface facing the wind direction adjustment unit, and the wall roundly extending from a surface of the third portion, and the guide unit extends flat to have the same inclination as the third portion.

2. The indoor unit according to claim 1, wherein the guide unit is integrally formed with the drainage tray unit.

3. The indoor unit according to claim 1, wherein the guide unit restricts a rotation range of the blade by interfering with the blade when the blade is opened.

4. The indoor unit according to claim 1, wherein the blade and the guide unit are disposed in parallel with each other while the blade is completely opened.

5. The indoor unit according to claim 1, wherein the blade makes a surface contact with the guide unit to prevent the cold air from leaking through a gap between the blade and the guide unit in a state in which the blade is completely opened.

6. The indoor unit according to claim 1, wherein a support shaft coupling unit that rotatably supports the blade is provided in the guide unit.

7. The indoor unit according to claim 6, wherein the blade includes a support shaft that is rotatably supported by the support shaft coupling unit.

8. The indoor unit according to claim 1, wherein the blade includes an insulating material that is provided between an inner surface of the blade and an outer surface of the blade to prevent a conductive heat transfer between cold air of the inner surface of the blade and the outer surface of the blade.

* * * * *